United States Patent [19]

Schaefer et al.

[11] 4,370,830

[45] Feb. 1, 1983

[54] SLIDING WINDOW

[75] Inventors: Hans Schaefer, Cologne; Wolfgang Budich, Troisdorf, both of Fed. Rep. of Germany

[73] Assignee: Dynamit Nobel Aktiengesellschaft, Troisdorf, Fed. Rep. of Germany

[21] Appl. No.: 194,815

[22] Filed: Oct. 7, 1980

[30] Foreign Application Priority Data

Jun. 28, 1980 [DE] Fed. Rep. of Germany ..... 3024555

[51] Int. Cl.[3] ..... E05D 15/06

[52] U.S. Cl. ..... 49/413; 49/404; 49/504; 428/464

[58] Field of Search ..... 49/413, 504, 408, 501, 49/404; 428/31, 464

[56] References Cited

U.S. PATENT DOCUMENTS

| | | | |
|---|---|---|---|
| 3,130,456 | 4/1964 | Migneanlt et al. | 49/413 X |
| 3,859,754 | 1/1975 | Budich et al. | 49/504 X |
| 3,947,998 | 4/1976 | Matsabara | 49/404 X |
| 4,042,004 | 8/1977 | Kwan | 49/413 X |
| 4,131,571 | 12/1978 | Crawley et al. | 428/464 X |
| 4,286,716 | 9/1981 | Budich et al. | 49/404 X |

FOREIGN PATENT DOCUMENTS

| | | | |
|---|---|---|---|
| 929984 | 7/1973 | Canada | 428/31 |
| 558870 | 2/1975 | Switzerland | 49/504 |

*Primary Examiner*—Kenneth Downey

*Attorney, Agent, or Firm*—Antonelli, Terry & Wands

[57] ABSTRACT

A sliding window with a frame provided with a glazing adapted to be mounted in a wall of masonry, wood, or the like. The frame is composed of frame profiles joined at the corners and contains glass panes inserted therein. The glass panes are guided in grooves of the frame profiles and are horizontally displaceable. The frame profile members are constructed of an extrudable synthetic resinous material, with the profile members having a U-shaped cross sectional configuration made up of two projections fashioned as hollow chambers. An undercut mounting groove is arranged between the two projections and a web, connecting the projections, is formed of two juxtaposed hollow chambers. One of the juxtaposed hollow chambers facing a weather side of the window is provided with perforations for draining the mounting groove, with a second of the juxtaposed hollow chambers containing, if desired, an inserted reinforcing profile. A sliding rail is inserted in the mounting groove of a lower horizontal frame profile of the frame.

35 Claims, 7 Drawing Figures

SLIDING WINDOW

The present invention relates to a window construction and, more particularly, to a sliding window with a frame, provided with a glazing, which frame is adapted to be mounted in a wall made of masonry, wood, or the like, and which frame includes frame profiles joined at the corners and containing glass panes inserted in the frame, which panes are guided in grooves of the frame profiles and are horizontally displaceable.

A sashless window construction, fashioned as a horizontal sliding window, is proposed in, for example, U.S. Pat. No. 3,396,491 wherein the material of the frame is wood. A disadvantage of this construction resides in the fact that the wood working technology does not fulfill or only imperfectly fulfills the following technically necessary functions.

First, drainage for penetrating rainwater in the lower sliding groove and/or an inside of the glass pane at a lower horizontal frame leg is inadequate since such drainage must be established by small tubes drilled through the wooden frame. In case of extensive rains, the drainage by the small tubes is insufficient. Moreover, the providing of a necessary sealing between the wood and the tube also causes problems and, with the poor drainage, water may remain thereby lending to a swelling, rotting, or a warping of the wooden frame.

Secondly, with a window frame construction such as proposed in the aforementioned United States Patent, the seal between the sliding glass pane and the window frame toward the outside and/or inside is inadequate. In this connection, the proposed window constructions do not include a flexible seal toward the outside between the glass pane and the wooden frame but rather attempt to attain a sealing action by a mechanical pressure of the glass against the wood. Such attempt of course leads to only an unsatisfactory result. Additionally, the inner flexible seal is arranged in such a manner that, considering the possibilities of wood working technology this seal likewise only has a limited effectiveness.

While attempts have been made to improve this situation by twin glass pane constructions such attempts have only met with partial success since the above-noted deficiencies also occur in a double pane construction.

The aim underlying the present invention essentially resides in providing an inexpensive sashless sliding window constructed in a simple manner of a minimum number of accessory parts, which window is especially suitable for zones with a warm climate and is made of a material which is not subjected to rotting in addition to being easy to maintain.

In accordance with the present invention, in order to meet the requirements for ruggedness and functional effectiveness, the frame of the sashless window is fashioned of a synthetic resinous material.

By virtue of the utilization of a synthetic resinous material for constructing the frames of a sashless sliding window, it is possible to provide a frame profile with a U-shaped cross section of two projections formed as hollow chambers, between which is disposed an undercut mounting groove, with a web connecting the projections and consisting of two hollow chambers arranged side by side, wherein a hollow chamber facing the weather side is provided with perforations for enabling a draining of the mounting groove. The second hollow chamber may, if desired, contain an inserted reinforcing profile. Moreover, a sliding rail may be inserted in the mounting groove of the lower horizontal frame profile element of the frame.

The above-noted disadvantages of the conventional sashless windows are eliminated in accordance with the present invention in that the frame may be constructed with only a single frame profile. Moreover, due to the selection of the material, i.e., a synthetic resinous material, a rotting of the frame is avoided and/or a considerably longer lifetime is ensured without constant servicing.

Moreover, it is possible to ensure the existence of a sufficient seal for the window by the provision of continuously external sealing profiles and, to ensure the existence of a sufficient contact pressure so as to prevent rattling as well as to close the sealing joints, it is possible to utilize fixedly mounted wedges in a simple manner. Additionally, by virtue of the provision of two hollow chambers, the functions of drainage and possibly required reinforcement of the frame in case of relatively large dimensions are fulfilled. Also, the sliding of the glass panes in the frame and/or on the lower horizontal frame profile is made possible by means of a very simply constructed sliding rail of a slidable or low friction material, which rail, depending upon its configuration, can either be clipped into the mounting groove or can be laterally inserted, prior to the assembly of the frame in the frame profiles.

Advantageously, in accordance with the present invention, the frame profiles may, for example, be welded or mechanically connected and sealed at miter-cut corners of the frame profiles.

Additionally, to enable an insertion of external sealing profiles, the provision is made that the projection of the frame profile facing the weather side of the window is fashioned, on an inside facing the mounting groove, with an undercut having an approximately T-shaped groove.

In accordance with further advantageous features of the present invention, to enable an insertion of external sealing provides, a projection of the frame profile facing the weather side of the window is constructed, on an inside facing the mounting groove, with an undercut in the form of an approximately T-shaped groove.

In accordance with the present invention, in order to facilitate insertion of the glass pane in the frame and also a dismounting of the glass pane from the frame, the projection facing inside of the window is constructed, on a side facing the mounting groove, with a rounded or beveled portion at an opening of the mounting groove.

Preferably, in accordance with further features of the present invention, the sliding rail for the glass panes has an approximately U-shaped cross sectional configuration with the legs of the U-shape being inclined slightly toward the outside thereby enabling the glass panes to slide thereon. The selected material for the sliding rail may be, for example, a polyamide, polyethylene, or the like. The sliding rail may either be clipped by compressing the same into the undercut mounting groove whereby the rail is then retained without any further auxiliary means, or the rail may be inserted from the side in the mounting groove prior to an assembly of the frame.

A particularly simple and effective sealing of the glass panes so as to prevent penetration of rainwater and rattling in a closed condition is achieved in accordance with the present invention by arranging wedges at the horizontal frame profiles of the frame in the corner zones thereof, with the wedges projecting into the mounting groove and urging the glass panes against the sealing profiles.

Advantageously, the wedge extends in an ascending direction from the frame center to the frame rim whereby the gradual contact pressure against the glass panes is made possible.

In order to seal a central part of the glass panes, in accordance with still further features of the present invention, eccentrically mounted disks are provided centrally at the lower and upper horizontal frame profiles of the frame. The disks are adapted to urge the glass panes against the external sealing profiles when the window is closed. These simple constructions are especially advantageous in tropical countries since, in these locations, the glass panes are not operated over long periods during the year and thus the disks fulfill their function entirely adequately.

Suitable extrudable thermoplastic synthetic resinous materials for the frame profiles of the present invention are, for example, a hard polyvinylchloride (PVC) and its modifications. The hard PVC may be rendered more resistant against attacks by weathering on the hard PVC surface by the addition of stabilizers and ultraviolet (UV) absorbents.

It is also possible to provide the side of the frame profile facing the weather with a further substantially more weather resistant and UV resistant synthetic resinous layer, especially, on the basis of polymers of acrylic acid and/or methacrylic acid and the copolymers on the basis of the acrylic acid esters and/or methacrylic acid esters, for example, polymethyl methacrylate. This synthetic resinous layer may be joined to the frame profile by, for example, coextrusion during a manufacture of the latter or it can be subsequently applied by spread-coating, spray-coating, or the like whereby laminating the frame profile with an appropriate film.

As can be readily be appreciated, the frame construction of the present invention is readily adaptable to accommodate an appropriate fly or insect screen.

In accordance with further advantageous features of the present invention, the provision is made that only one of the two glass panes is arranged so as to be displaceable. Such an arrangement is normally sufficient for many climate zones and applications. The second window pane is considered as the fixed glazing or glass pane in this structure but it is arranged in the frame in such a manner that it can be lifted out for cleaning and replacement after the displaceable glass pane has previously been removed from the frame.

It is also possible in accordance with the present invention to provide a frame profile construction wherein the projections are fashioned, on a side facing the mounting groove with mutually opposed identical grooves into which may be inserted, if desired, a rectangular sliding rail for the glass panes. The advantage of this construction reside in the fact that an even simpler profile, namely, a rectangular solid profile, may be used in place of a U-shaped profile. Such rectangular profiles may, for example, be made of a suitable material such as polyamide or polyethylene. Additionally, such rectangular profiles may be obtained directly as semifinished products and thus do not require special expenses for manufacturing and assembly. Moreover, in a frame profile constructed in this manner, it may also be advantageous to additionally insert an H-shaped auxiliary or supplemental profile in the mounting groove on which the sliding rail may be partially placed, which supplemental profile, depending on its use, may be equipped with an external or internal sealing profile.

For all useages wherein, due to increased requirements such as, for example, regarding heat and cold protection and/or noise attenuation, a dual glazing is desirable and such dual glazing may be obtained in accordance with the present invention by a series arrangement of two frames made from the frame profile, which two frames are optionally firmly joined together.

Accordingly, it is an object of the present invention to provide a sliding window which avoids, by simple means, shortcomings and disadvantages encountered in the prior art.

Another object of the present invention resides in providing a sealing window which is simple in construction and therefore relatively inexpensive to manufacture.

Yet another object of the present invention resides in providing a sliding window which has a relatively long lifetime and a minimum amount of servicing.

A further object of the present invention resides in providing a sliding window which ensures the existence of an adequate and tight seal between the glass panes of the window.

Yet another object of the present invention resides in providing a sliding window having a frame which is not subjected to swelling, rotting, or warping.

A still further object of the present invention resides in providing a sliding window which ensures the existence of an adequate water drainage.

These and other objects, features, and advantages of the present invention will become more apparent from the following description when taken in connection with the accompanying drawings which show, for the purposes of illustration only, several embodiments in accordance with the present invention, and wherein.

Figure 1:
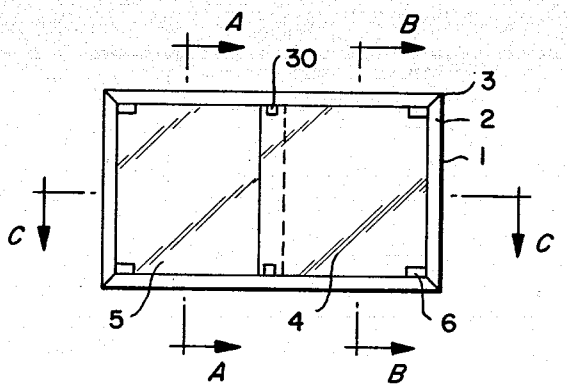
FIG. 1 is a partially schematic inside plan view of a sashless sliding window in accordance with the present invention.
Figure 4:
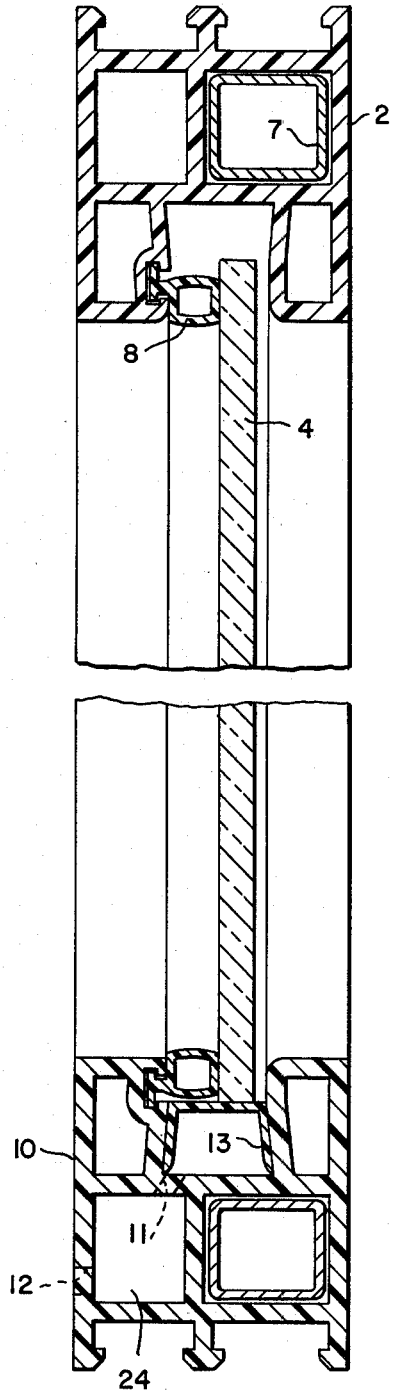
Figure 5:
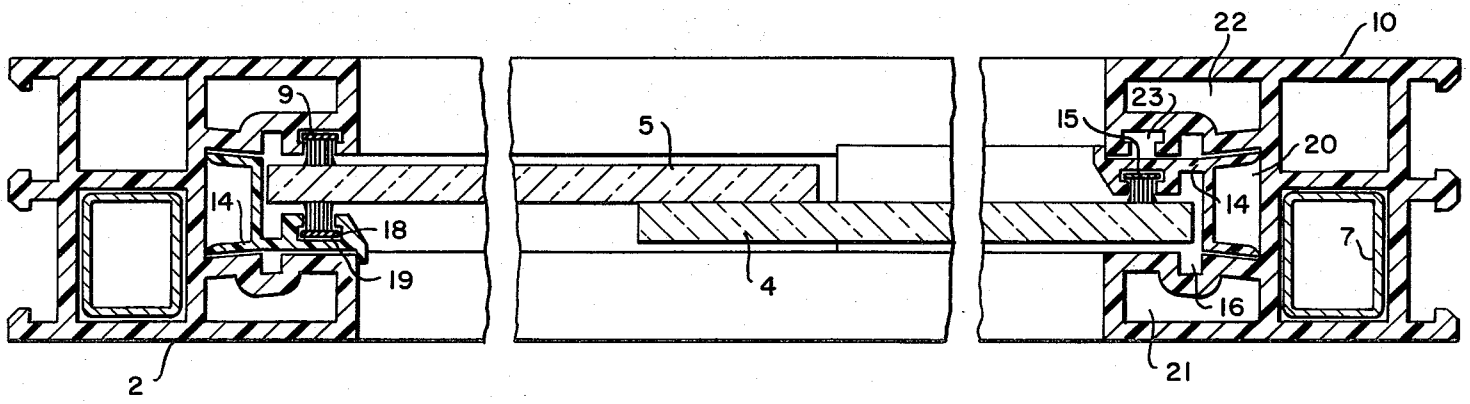
Figure 6:
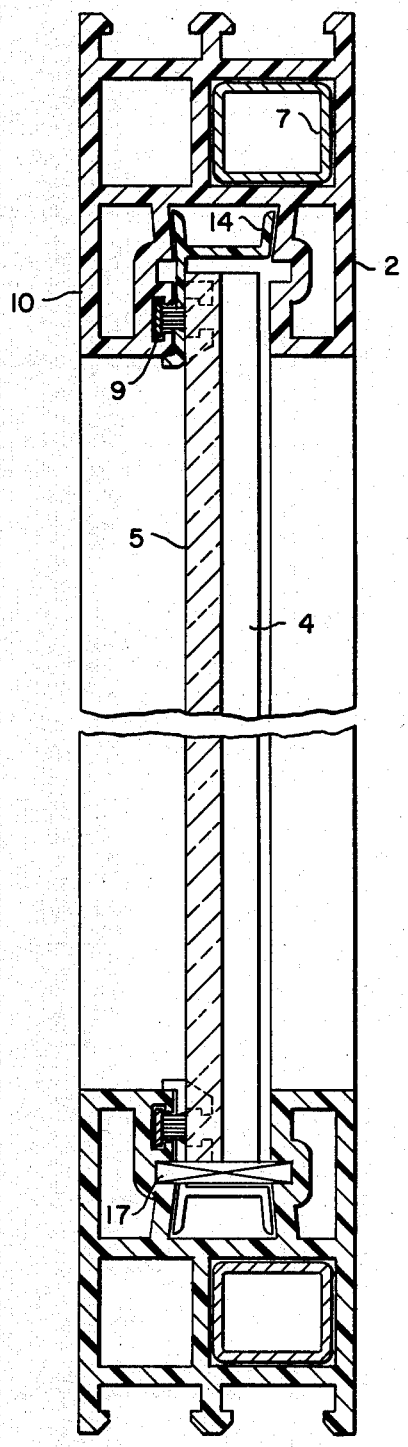
Figure 7:
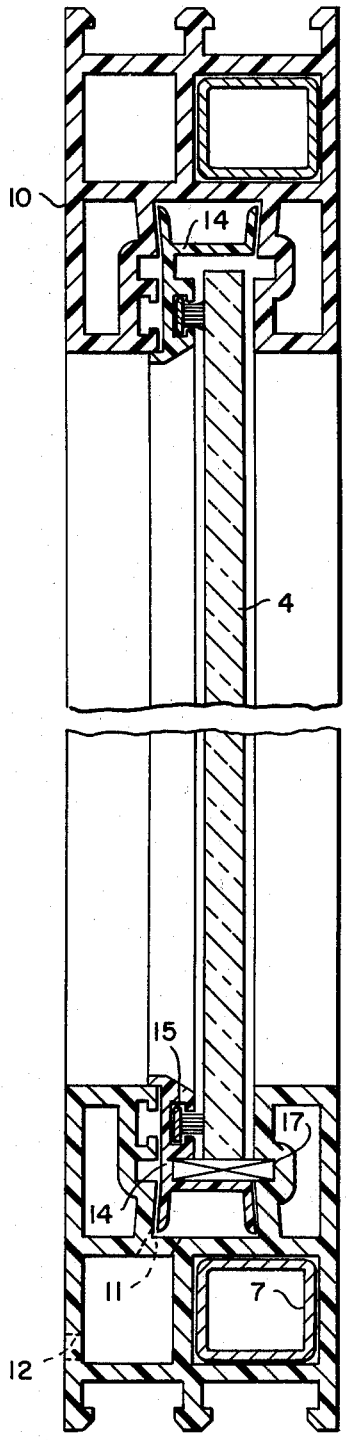

FIG. 4 iis a partially schematic vertical cross sectional view taken along the line B—B in FIG. 1;

FIG. 5 is a partially schematic cross sectional view of a modified frame profile arrangement taken along the line C—C of FIG. 1;

FIG. 6 is a partially schematic cross sectional view of the modified frame profile arrangement of FIG. 5 taken along the line A—A of FIG. 1; and FIG. 7 is a partially schematic vertical cross sectional view of the frame profile arrangement of FIG. 5 taken along the line B—B of FIG. 7.

Referring now to the drawing wherein like reference numerals are used throughout the various views to designate like parts and, more particularly, to the schematic plan view of the sashless sliding window of FIG. 1, according to this Figure, a window frame 1, adapted to be installed in a wall (not shown) of masonry, wood, or the like, includes frame profiles 2 miter-cut to size in correspondence with the size of the window to the lengths of the individual window sides and firmly joined together at the corners. The joints formed at the corners can be connected by, for example, welding, a screw connection, cementing, or optionally with the use of additional connecting members insertable in the frame profiles 2 in the corner zones. Glass panes 4, 5 are inserted in the frame 1, with the glass panes 4, 5 being horizontally displaceable. Wedges 6 are arranged in the corner zones at the lower and upper horizontal frame profiles and are attached at those zones in order to ensure the existence of a tight fit and firm clamping of the glass panes 4, 5 in the closed condition of the window. As can readily be appreciated, it is possible to construct the sashless sliding window so that only one of the two glass panes 4, 5 is displaceable. More particularly, it is possible for the glass pane 4 to be displaceable whle the glass pane 5 is fixed but yet is adapted to be lifted out of the frame 1 for either cleaning purposes or for dismounting.

Figure 2:
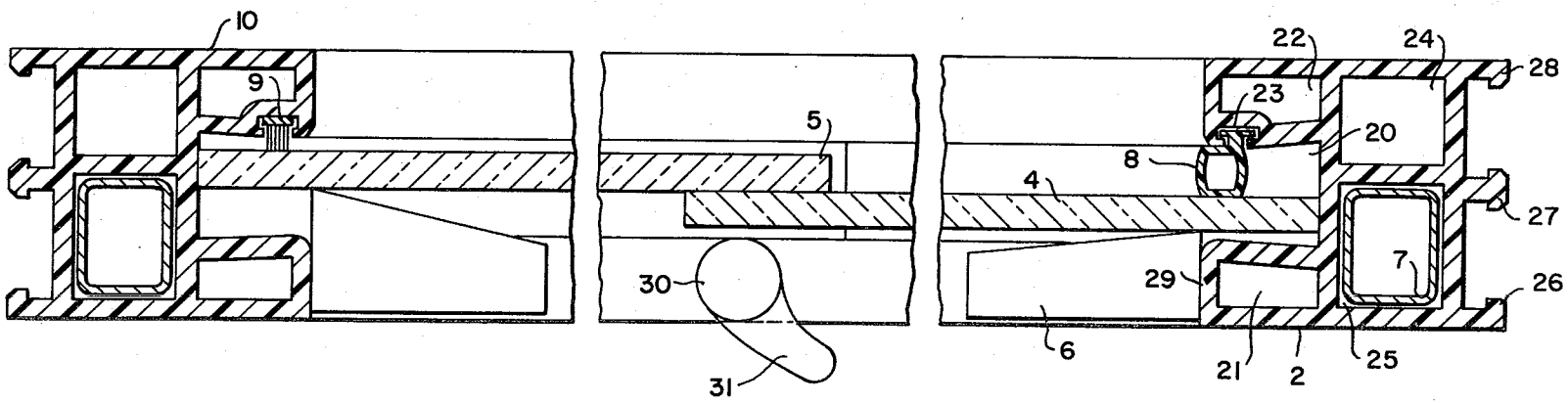
FIG. 2 is a partially schematic horizontal cross-sectional view taken along th line C—C in FIG. 1.

As shown in the horizontal cross section of FIG. 2, the frame profile 2 is fashioned as an approximately U-shaped multiple chambered hollow profile member wherein legs of the U-shape are formed by projections 21, 22 which form the respective hollow chambers and define therebetween a slightly undercut mounting groove 20 for enabling a guidance of the glass panes 4, 5. In order to improve both the inserting and lifting out of the glass panes 4, 5 the projection 21, facing the inside of the room, is provided with a beveled or rounded portion on an inner edge 29 facing the groove 20.

A web connecting the projections 21, 22 forms the main cross section of the frame profile member 2. The web is preferably formed with two juxtaposed hollow chambers 24, 25. The hollow chambers 24, 25 need not be of equal size and, while the chambers 24, 25 are illustrated as having a rectangular cross section, other configurations of the chambers 24, 25 are also possible. The hollow chamber 24, facing the weather side of the window, is preferably constructed as a drainage chamber for the mounting groove 20.

Figure 3:
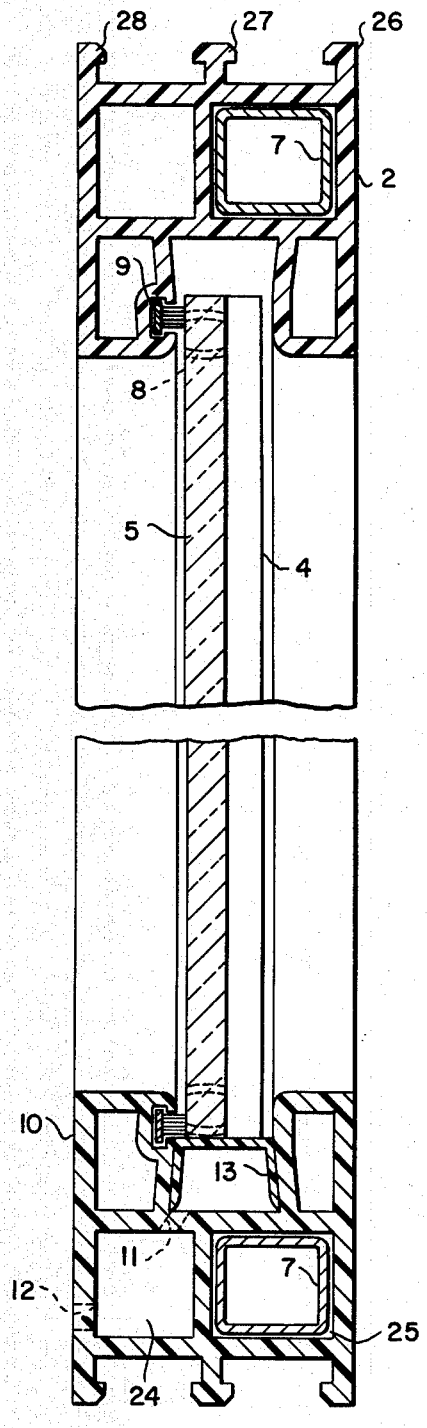
FIG. 3 is a partially schematic vertical cross sectional view taken along the line A—A in FIG. 1.

As shown most clearly in FIGS. 3 and 4, perforations 11, 12 connect or communicate with the mounting groove 20 so as to enable the drainage thereof. Advantageously, the hollow chamber 25 facing the inside of the room may also be used for accommodating reinforcing profiles 7. The reinforcing profiles 7 may, for example, be aluminum, galvanized steel profiles, etc. In this connection, it is also possible to employ closed rectangular profiles such as shown in the drawings as well as, for example, open C-shaped profiles or the like. On the side of the window to be joined to the adjacent wall, masonry, or the like, the frame profile members 2 are provided with projections 26, 27, 28. The projections 26, 27, 28 have a hook-like formation on their ends so as to enable an anchoring of the window at the wall, masonry, or the like. In this situation, the frame 1 would be attached by means of anchors and screws (not shown).

As shown most clearly in FIGS. 3 and 4, the glass panes 4, 5 are adapted to slide on U-shaped sliding rails 13 which are inserted in the mounting groove 20 of the lower horizontal frame profile member 2. The sliding rail 13 may, for example, be extruded from polyethylene or a polyamide and, preferably, has a slightly conical shape. The rail 13 may, during assembly, be inserted in the frame profile member 2 from the side thereof before the frame profile members 2 are assembled into the window frame. However, it is also possible to clip the sliding rail 13 directly in the mounting groove 20 by compressing the legs thereof. Due to the slightly conically diverging configuration of the sliding rail 13 and the undercut configuration of the mounting groove 20, with the clipping of the sliding rail into the mounting groove, it would be impossible for the sliding rail 13 to drop out of the mounting groove 20 during use. To facilitate the moving of the glass panes 4, 5 the sliding surface of the sliding rail 13 may, for example, be profiled with projecting beads (not shown). As noted above, any water entering the window frame 1, is collected in the mounting groove 20 and is drained to the outside of the window frame 1 through perforations 11, 12 and hollow chamber 24.

Preferably, the edges of the glass panes 4, 5 are constructed so as to be slightly rounded and, depending upon the size of the glass panes, it is sufficient to provide the glass panes 4, 5, in a conventional manner, with relatively simple handles (not shown) so as to facilitate displacement of the respective glass panes 4, 5, as well as closures (not shown) so as to enable a locking of the window.

As shown in FIGS. 1–4, sealing profiles 8, 9 are inserted in grooves 23 provided in the outer projections 22. Preferably, the grooves 23 have a T-shaped configuration. The sealing profiles 8, 9 are adapted to seal the glass panes 4, 5 with respect to the exterior of the window. The different configuration between the sealing profile 8, 9 is necessitated by the difference in distances between the respective pane surfaces and the projection 22. Advantageously, a brush-type sealing means 9 is provided in the profile member 2 in a region of the glass pane 5 which is in close contact with the outer projection 22; whereas, the projection 22 is equipped with a larger lip-type sealing profile 8 in a zone of the inner glass pane 4. Wedges 6 (FIG. 1) are disposed on the lower and upper frame profiles so as to furnish the necessary contact pressure of the glass panes 4, 5 against the outer sealing profiles 8, 9 in a closed condition of the window. The wedges 6, during a closing of the glass panes 4, 5 urge the glass panes 4, 5 against the outer sealing profiles 8, 9 in a zone of the mounting groove 20.

A sealing action may be attained in a central zone of the glass panes 4, 5 by, for example, mounting a simple disk member 30 eccentrically to the upper and lower horizontal frame profile members 2 whereby the glass panes 4, 5 are likewise urged against the outer sealing profiles 8, 9. As shown in FIG. 2, the disk 30 may be equipped with a lever 31.

Depending upon the nature of the synthetic resinous material employed for forming the frame profile members 2, which are preferably produced by extrusion, wherein also reinforced plastics may be utilized, the outer side of the frame profile members 2 exposed to a weathering, may furthermore be provided with an additional, weather resistant skin or layer. In this connection, suitable materials for the weather resistant skin and/or layer are weatherable synthetic resinous such as polymers of acrylic acid and methacrylic acid, e.g., polymethal methacrylate.

For example, with a wather resistant skin of polymethal methacrylate, such skin may either be applied by coextrusion simultaneously with the extrusion of the frame profile 2 or the skin may be applied by, for example, subsequently varnishing or laminating an appropriate film thereto. Preferably, the weatherable synthetic resinous layer 10 is provided, on an entire side of the frame profile on the outside of the window which is exposed to weathering, that is, along the hollow chambers 24 and the projections 22 up to the beginning of the sealing profiles 8, 9.

FIGS. 5–7 provide an example of a window frame 1 having an improved joint tightness and greater rainwaterproofness in comparison with the above described embodiment of FIGS. 2–4. For this purpose, an auxiliary profile 14 of, for example, a hard PVC is provided, with the auxiliary profile 14 having an approximately H-shaped cross sectional configuration. The frame members 2 in which the auxiliary profiles 14 are mounted have the same basic cross section of the construction of FIGS. 2–4. The two legs or U-shaped portion of the H-shaped auxiliary profile 14 is inserted in the mounting groove 20 of the frame profile 2 with the upright leg portion of the profile 14 being provided with a T-shaped groove 19 for receiving a sealing profile 15 or 18. The auxiliary profile 14 may be selectively inserted in the mounting groove 20 so that the upright leg portion faces either the inside or the outside of the frame 1 depending upon the seating of the glass panes 4, 5 in the frame 1. Thus, as shown in FIG. 5, the sealing profile 18 provides an inner seal for the glass pane 5 and the sealing profile 15 provides an outer seal for the glass pane 4.

The auxiliary profile 14 may be made, for example, of a low friction or readily slip-providing material so that is possible to seat the glass panes 4, 5 directly on the auxiliary profile 14 and to slide the panes 4, 5 therealong. However, as shown in FIGS. 6 and 7, it is also possible to arrange an additional rectangularly shaped sliding rail 17, which rail 17 is placed on the auxiliary profile 14 in an area of the glass pane 4 and/or is held, in a zone of the glass pane 5, in grooves 16 additionally formed in the projections 21, 22 of the frame profile member 2.

In order to provide a window having increased noise protection and/or insulating properties with respect to heat and cold, it is possible in a simple manner to arrange two frames 1 one behind the other and/or to couple such frames with each other so as to produce a double glazed or dual pane window.

While I have shown and described several embodiments in accordance with the present invention, it is understood that the same is not limited thereto but is susceptible of numerous changes and modifications as known to one having ordinary skill in the art and I therefore do not wish to be limited to the details shown and described herein, but intend to cover all such modifications as are encompassed by the scope of the appended claims.

I claim:

1. A sashless sliding window which includes a frame to be mounted in a wall of masonry, wood, or the like, the frame comprising a plurality of frame profile members joined at corners of the frame, and glass panes adapted to be inserted in the frame, means are provided in the frame for displacably guiding at least one of the glass panes in a horizontal direction, characterized in that each of the frame members is made of an extrudable synthetic resinous material and has a substantially U-shaped cross sectonal configuration with legs of the U-shape being formed by two projections, each of the two projections being fashioned as a hollow chamber, the guiding means includes an undercut mounting groove arranged at least in an upper and lower profile member of the frame between the two projections for accommodating the glass panes, a web means is provided for connecting the two projections to each other, the web means is formed by two juxtaposed additional hollow chambers, means are provided in one of the additional hollow chambers facing a weather side of the window for draining the undercut mounting groove, and in that the guiding means further includes a sliding rail means arranged at least in the undercut mounting groove of the lower profile member of the frame for facilitating a horizontal displacement of the at least one of the glass panes.

2. A sliding window according to claim 1, characterized in that reinforcing means are arranged in the other of the additional hollow chambers.

3. A sliding window according to claim 2, characterized in that the reinforcing means is a hollow profile member.

4. A sliding window according to one of claims 1 or 2, characterized in that an undercut groove means is formed in one of the projections facing a weather side of the window for accommodating a sealing means.

5. A sliding window according to claim 4, characterized in that the undercut groove means has an approximately T-shape, and in that the sealing means is a sealing profile.

6. A sliding window according to claim 4, characterized in that means are provided at an opening of the mounting groove at the projection facing an inside of the window for facilitating insertion of the glass panes.

7. A sliding window according to claim 6, characterized in that the facilitating means includes one of a rounded and beveled end portion provided on the projection.

8. A sliding window according to claim 6, characterized in that the sliding rail means has an approximately U-shaped cross sectional configuration with legs of the U-shaped being inclined slightly outwardly, and in that the sliding rail means is fashioned of a low friction material.

9. A sliding window according to claim 8, characterized in that the low friction material is one of a polyamide or polyethylene.

10. A sliding window according to claim 8, characterized in that means are arranged at least in corner zones of the upper and lower profile members for urging the glass panes against the sealing means.

11. A sliding window according to claim 10, characterized in that the urging means are wedge members adapted to project into the mounting groove.

12. A sliding window according to claim 10, characterized in that means are arranged at one of the lower profile member or at the upper and lower profile members for pressing the glass panes against the sealing means.

13. A sliding window according to claim 12, characterized in that the pressing means are formed as disk members eccentrically arranged in a middle area of the window.

14. A sliding window according to claim 12, characterized in that a protective layer is provided on a side of the frame profile members exposed to the weather.

15. A sliding window according to claim 14, characterized in that the protective layer is formed of an additional synthetic resinous material.

16. A sliding window according to claim 15, characterized in that the additional synthetic resinous material is ultraviolet resistant.

17. A sliding window according to claim 16, characterized in that the additional synthetic resinous material is a polymer of one of an acrylic acid or a methacrylic acid.

18. A sliding window according to claim 16, characterized in that the additional synthetic resinous material is a copolymer of one of acrylic acid esters or methacrylic acid esters.

19. A sliding window according to claim 18, characterized in that the additional synthetic resinous material is polymethyl methacrylate.

20. A sliding window according to claim 15, characterized in that the additional synthetic resinous material is coextruded with the frame profile members.

21. A slding window according to claim 15, characterized in that the additional synthetic resinous material is laminated to the frame profile members.

22. A sliding window according to claim 15, characterized in that the additional synthetic resinous material is spread coated on the frame profile members.

23. A sliding window according to claim 15, characterized in that the glass panes are arranged so as to be horizontally displaceable.

24. A sliding window according to claim 15, characterized in that two frames are provided and arranged in series, and in that means are provided for firmly joining the two frames together so as to form a twin-paned sliding window.

25. A sliding window according to claim 4, characterized in that further groove means are provided in mutually opposed surfaces of the two projections for accommodating the sliding rail means.

26. A sliding window according to claim 25, characterized in that the sliding rail means has a rectangular configuration.

27. A sliding window according to claim 25, characterized in that an auxiliary profile means is provided for supporting the sliding rail means at the frame members and for accommodating the sealing means at least at one of an internal and external side of the window.

28. A sliding window according to claim 27, characterized in that the auxiliary profile means has a substantially H-shaped cross sectional configuration.

29. A sliding window which includes a frame to be mounted in a wall of masonary, wood, or the like, the frame comprising a plurality of frame profile members joined at corners of the frame, and glass panes adapted to be inserted in the frame, means are provided in the frame for guiding the glass panes so as to be horizontally displaceable characterized in that each of the frame members is made of an extrudable synthetic resinous material and has a substantially U-shaped cross sectional configuration with legs of the U-shape being formed by two projections, each of the two projections being fashioned as a hollow chamber, the guiding means includes an undercut mounting groove arranged at least in an upper and lower profile member of the frame between the two projections, a web means is provided for connecting the two projections, the web means if formed by two juxtaposed additional hollow chambers, means are provided in one of the additional hollow chambers facing a weather side of the window for draining the undercut mounting groove, the guiding means further includes a sliding rail means arranged at least in the undercut groove of the lower profile member of the frame, an undercut groove means is formed in one of the projections facing a weather side of the window for accommodating a sealing means, further means are provided in mutually opposed surfaces of the two projections for accommodating the sliding rail means, an auxiliary profile means is provided for supporting the sliding rail means at the frame members and for accommodating the sealing means at least at one of an internal and external side of the window, the auxiliary profile means has a substantially H-shaped cross sectional configuration, two fames are provided and arranged in series, and in that the means are provided for firmly joining the two frames together so as to form a twin-paned sliding window.

30. A sliding window according to claim 1, characterized in that means are arranged at least in a corner zone of the upper and lower profile members for urging the glass pairs against sealing means of the window.

31. A sliding window according to claim 1, characterized in that means are arranged at one of the lower profile member or at the upper and lower profile members for pressing the glass panes against sealing means of the window.

32. A sliding window according to claim 1, characterized in that a protective layer is provided on a side of the frame profile members exposed to weather.

33. A sliding window according to claim 1, characterized in that all of the glass panes are arranged so as to be horizontally displaceable.

34. A sliding window according to claim 1, characterized in that further groove means are provided in mutually opposed surfaces of the two projections for accommodating the sliding rail means.

35. A sliding window according to claim 34, characterized in that an auxiliary profile means is provided for supporting the sliding rail means at the frame members and for accommodating sealing means of the window.

* * * * *